US006951503B1

(12) United States Patent
Gotkis et al.

(10) Patent No.: US 6,951,503 B1
(45) Date of Patent: Oct. 4, 2005

(54) SYSTEM AND METHOD FOR IN-SITU MEASURING AND MONITORING CMP POLISHING PAD THICKNESS

(75) Inventors: Yehiel Gotkis, Fremont, CA (US); Simon McClachie, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/879,654

(22) Filed: Jun. 28, 2004

(51) Int. Cl.[7] ..... B24B 49/00
(52) U.S. Cl. ..... 451/9; 451/21; 451/41
(58) Field of Search ..... 451/5, 6, 9, 10, 451/21, 41, 56, 288, 289, 290, 307

(56) References Cited

U.S. PATENT DOCUMENTS

| | | | | |
|---|---|---|---|---|
| 5,934,974 | A * | 8/1999 | Tzeng | 451/6 |
| 5,974,679 | A * | 11/1999 | Birang et al. | 33/553 |
| 6,040,244 | A * | 3/2000 | Arai et al. | 438/691 |
| 6,186,864 | B1 * | 2/2001 | Fisher et al. | 451/6 |
| 2002/0137434 | A1 * | 9/2002 | Choi et al. | 451/28 |
| 2003/0060127 | A1 * | 3/2003 | Kaushal et al. | 451/8 |
| 2004/0038623 | A1 * | 2/2004 | Chandrasekaran | 451/5 |
| 2004/0192168 | A1 * | 9/2004 | Faustmann et al. | 451/5 |

* cited by examiner

*Primary Examiner*—Jacob K. Ackun, Jr.
(74) *Attorney, Agent, or Firm*—Martine Penilla & Gencarella, LLP

(57) ABSTRACT

A system for measuring and scanning a CMP polishing pad thickness is described. The system includes a first sensor arm capable of being moved in a direction substantially parallel with and at a substantially constant distance from a top surface of the CMP polishing pad. The system also includes a first proximity sensor mounted on the first sensor arm. The first proximity sensor being oriented toward the top surface of the CMP polishing pad. The first proximity sensor being capable of measuring a first distance between the first proximity sensor and the top surface of the CMP polishing pad. The system can also include a second sensor arm capable of being moved in a direction parallel with and at a substantially constant distance from a bottom surface of the CMP polishing pad and a second proximity sensor mounted on the second sensor arm, the second proximity sensor being oriented toward the bottom surface of the CMP polishing pad. The second proximity sensor being capable of measuring a second distance between the second proximity sensor and the bottom surface of the CMP polishing pad. A method of measuring CMP polishing pad thickness is also described.

19 Claims, 6 Drawing Sheets

SYSTEM AND METHOD FOR IN-SITU MEASURING AND MONITORING CMP POLISHING PAD THICKNESS

BACKGROUND OF THE INVENTION

1. Field of the Invention

The present invention relates generally to CMP polishing pads, and more particularly, to methods and systems for in-situ measuring and monitoring the thickness of a CMP polishing pad.

2. Description of the Related Art

The fabrication of semiconductor devices involves numerous processing operations. These operations include, for example, impurity implants, gate oxide generation, inter-metal oxide depositions, metallization depositions, photolithography patterning, etching operations, chemical mechanical polishing (CMP), etc. The typical CMP process includes applying a moving a polishing pad to the surface of the semiconductor substrate. Friction is generated between the polishing pad and the materials in surface of the semiconductor substrate. The friction removes a portion of the materials in the surface of the semiconductor substrate and also wears down the CMP polishing pad. As the CMP polishing pad wears, the polishing results become less and less predictable.

FIGS. 1A and 1B shows a typical belt-type CMP system 100. The belt-type CMP system 100 includes a polishing pad/belt 102 that is an integrated, continuous loop (hereafter the polishing pad). Two rollers 112 support the polishing pad 102. One or both of the rollers 112 can be driven to cause the polishing pad 102 to be driven in direction 108. A substrate support 106 supports a substrate 104. The substrate support 106 holds the substrate in a substantially constant location such as between lines 114A and 114B. The substrate support 106 applies a downward pressure 110 on the substrate 104 to push the substrate into the polishing pad 102 to generate the friction necessary to perform the polishing process. Typically, the polishing pad is used until the CMP results begin to fall below a predetermined performance level. The CMP pad is then replaced.

FIG. 1C shows a cross-sectional view (i.e., a profile view) of a typical, worn polishing pad 102. As multiple substrates 104 are polished, the polishing pad 102 begins to wear and "dish" in the center portion (i.e., between lines 114A and 114B). Unfortunately, there are no effective means to monitor the wear status of the polishing pad 102. As a result, at least some of the substrates polished with a worn polishing pad 102 will have to be reworked to address the shortfalls in the CMP process that are caused by the worn polishing pad. Typically, the profile view of the worn polishing pad 102 can only be achieved through destructive testing. Specifically, a strip of the polishing pad 102 is cut and measured to determine the wear. As shown, the polishing pad 102 includes multiple grooves 116 that extend linearly along the length of the polishing pad. The wear pattern in the polishing pad 102 is not shown to scale. Typically, if the thickness 118 of even one portion the polishing pad 102 is ward down by as little as about 100 micron, then the polishing performance of the polishing pad is degraded.

It should be noted that while the above problems with CMP polishing pads has been described in terms of a linear, belt-type CMP polishing pad, the same problems also apply to platen-type or rotary-type or orbital CMP polishing pads. In view of the foregoing, there is a need for a system and method for in-situ measuring and monitoring CMP polishing pad thickness and/or polishing surface profile.

SUMMARY OF THE INVENTION

Broadly speaking, the present invention fills these needs by providing systems and methods for in-situ measuring and monitoring CMP polishing pad thickness. It should be appreciated that the present invention can be implemented in numerous ways, including as a process, an apparatus, a system, computer readable media, or a device. Several inventive embodiments of the present invention are described below.

One embodiment provides a system of measuring and scanning a CMP polishing pad thickness. The system includes a first sensor arm capable of being moved in a direction substantially parallel with and at a substantially constant distance from a top surface of the CMP polishing pad. The system also includes a first proximity sensor mounted on the first sensor arm. The first proximity sensor being oriented toward the top surface of the CMP polishing pad. The first proximity sensor being capable of measuring a first distance between the first proximity sensor and the top surface of the CMP polishing pad. The system can also include a second sensor arm capable of being moved in a direction parallel with and at a substantially constant distance from a bottom surface of the CMP polishing pad and a second proximity sensor mounted on the second sensor arm, the second proximity sensor being oriented toward the bottom surface of the CMP polishing pad. The second proximity sensor being capable of measuring a second distance between the second proximity sensor and the bottom surface of the CMP polishing pad.

The first proximity sensor can be an eddy current sensor. The CMP polishing pad can be mounted on a platen. The platen can have a thickness greater than at least about five skin depths.

The first proximity sensor can include a cover, wherein the cover has a thickness equal to the first distance. The cover has a low co-efficient of friction with the top surface of the polishing pad. The first sensor arm holds the cover of the first proximity sensor against the top surface of the polishing pad.

The polishing pad can include a conductive portion of the polishing surface architecture. The polishing surface architecture includes at least one of a platen or a metallic part of the polishing belt.

The first proximity sensor and the second proximity sensor can be substantially aligned along in an axis that is substantially perpendicular to the top surface and the bottom surface of the CMP polishing pad. The CMP polishing pad can be mounted on a continuous belt and wherein the continuous belt is mounted on a pair of rollers.

The first proximity sensor can be at least one of a group consisting of a laser proximity sensor or a capacitive proximity sensor. Alternatively, the first proximity sensor can be an eddy current sensor (ECS) and the second proximity sensor can be a target. Alternatively, the target can be a conductive portion of the polishing pad. The system of claim 1, wherein the CMP polishing pad is mounted within a CMP process tool.

Another embodiment provides a method of measuring a thickness of a CMP polishing pad. The method includes placing a first proximity sensor a first distance from a top surface of the CMP polishing pad in an initial location. The first proximity sensor is moved to a second location and a second distance between the first proximity sensor and the top surface of the CMP polishing pad is measured at the second location. A thickness of the CMP polishing pad at the second location is determined and output. Determining the thickness of the CMP polishing pad at the second location can include determining a Δd.

The method can also include placing a second proximity sensor a third distance from a bottom surface of the CMP polishing pad in the initial location and moving the second proximity sensor to the second location on the bottom surface of the CMP polishing pad. A fourth distance between the second proximity sensor and the bottom surface of the CMP polishing pad is measured at the second location.

The first proximity sensor can be an eddy current sensor and a target is located below the CMP polishing pad at the second location. The target can be a platen.

Determining the thickness of the CMP polishing pad at the second location can include determining the thickness of the CMP polishing pad at the second location in-situ.

Yet another embodiment provides a method of measuring a thickness of a CMP polishing pad in-situ. The method includes placing a first proximity sensor a first distance from a top surface of the CMP polishing pad in an initial location. The CMP polishing pad being mounted in a CMP process tool. The first proximity sensor is moved to a second location and a second distance between the first proximity sensor and the top surface of the CMP polishing pad is measured at the second location. A second proximity sensor is placed a third distance from a bottom surface of the CMP polishing pad in the initial location and the second proximity sensor is moved to the second location on the bottom surface of the CMP polishing pad. A fourth distance is measured between the second proximity sensor and the bottom surface of the CMP polishing pad at the second location and a thickness of the CMP polishing pad at the second location is determined and output.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings.

DETAILED DESCRIPTION OF THE EXEMPLARY EMBODIMENTS

Several exemplary embodiments for systems and methods for in-situ measuring and monitoring CMP polishing pad thickness will now be described. It will be apparent to those skilled in the art that the present invention may be practiced without some or all of the specific details set forth herein.

Monitoring a polishing pad profile in-situ (i.e., as the polishing pad is mounted in the CMP process tool, ready to perform CMP operations), would allow for interactive compensation of the worn polishing pad and thereby avoiding rework on a substrate due to an incomplete or incorrect CMP process. Monitoring a polishing pad profile in-situ would also allow identification of a polishing pad that will cause less than optimum CMP operation and thereby allow replacement of the worn polishing pad before a substrate must be reworked.

One embodiment provides a system for measuring a polishing pad thickness. The system includes pair of proximity sensors that can be moved across the top and bottom of the polishing pad at a fixed distance from one another. The proximity sensors can be contact gauges, laser, capacitive, eddy current sensors (ECS) or any other type of suitable distance sensor. The proximity sensors can be mounted on a support that allows the sensors to be moved, substantially across the polishing pad. The support and the sensors can be moved either manually or automatically using an actuator.

Another embodiment provides a system for measuring a polishing pad thickness and includes an ECS. The ECS can measure a thickness of the polishing pad by detecting a difference in an eddy current caused by a target on the opposing side of the polishing pad or even a conductive portion of the polishing pad (e.g., metallic belt or mesh within the polishing pad). The ECS can be covered with a specifically profiled pad contacting knob. The pad contacting knob is manufactured from a non-conductive material (e.g., plastic, ceramic, glass, etc.) so as not to interfere with the ECS. The covered ECS is held on a first side of the polishing pad and a target is held in a corresponding position on the opposite side of the polishing pad. The distance between the ECS and the target is set to cover all possible polishing pad thickness variations. The ECS can be calibrated with a set of reference samples having known thicknesses. As a result, a signal/thickness calibration curve covering the desired measurement interval ultimately provides a direct, absolute measurement of the polishing pad thickness.

Figure 1A:
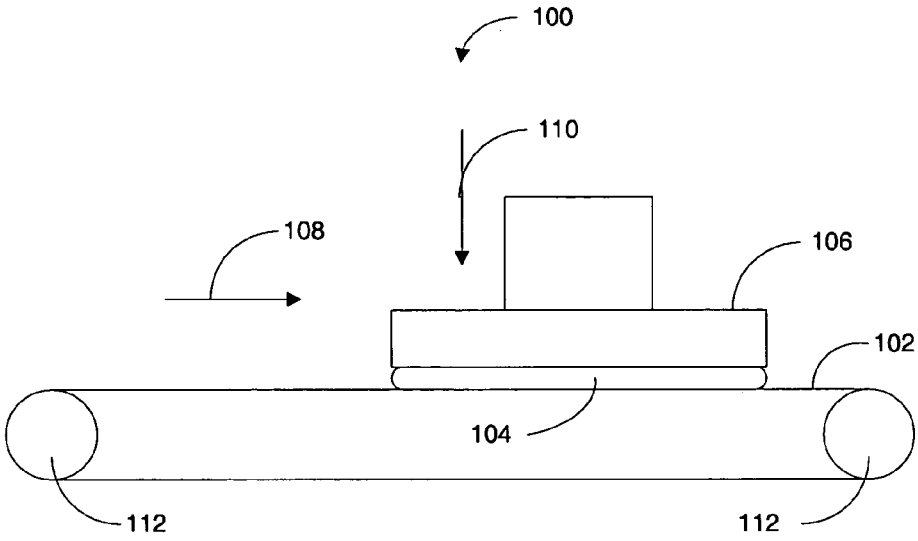
FIGURE 1A Prior Art
FIGS. 1A and 1B shows a typical belt-type CMP system
Figure 1B:
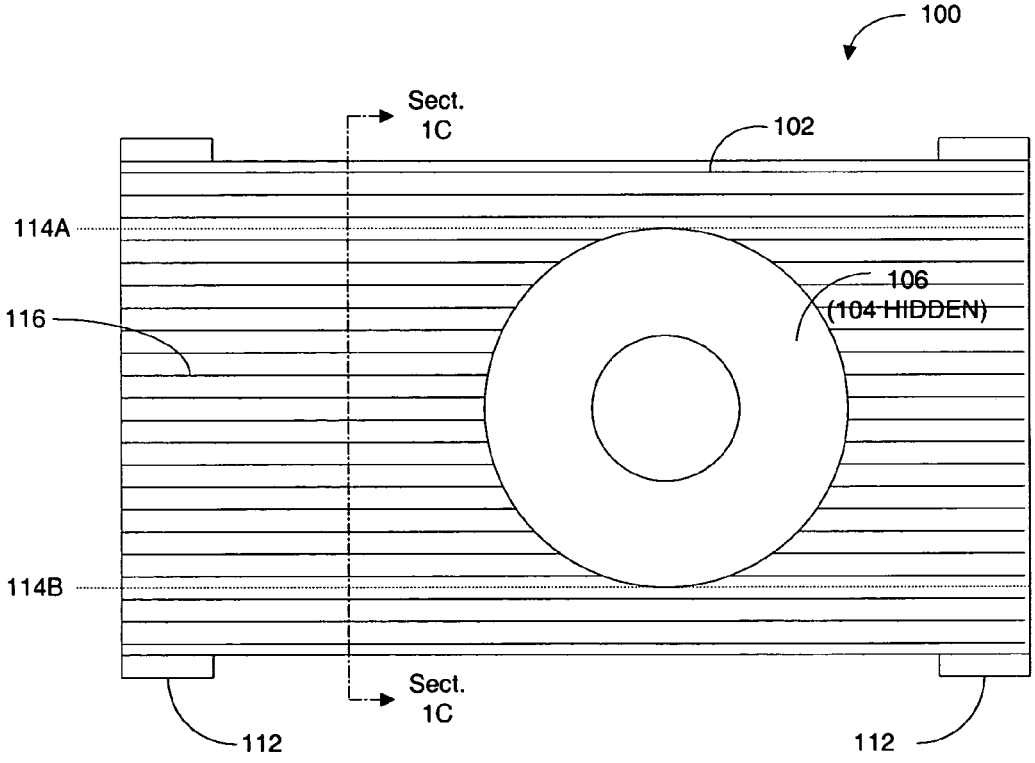
FIGURE 1B Prior Art
Figure 1C:
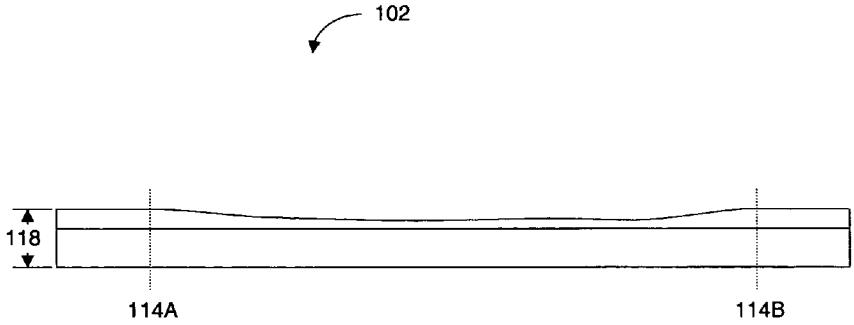
FIGURE 1C Prior Art
FIG. 1C shows a cross-sectional view (i.e., a profile view) of a typical, worn polishing pad.
Figure 2A:
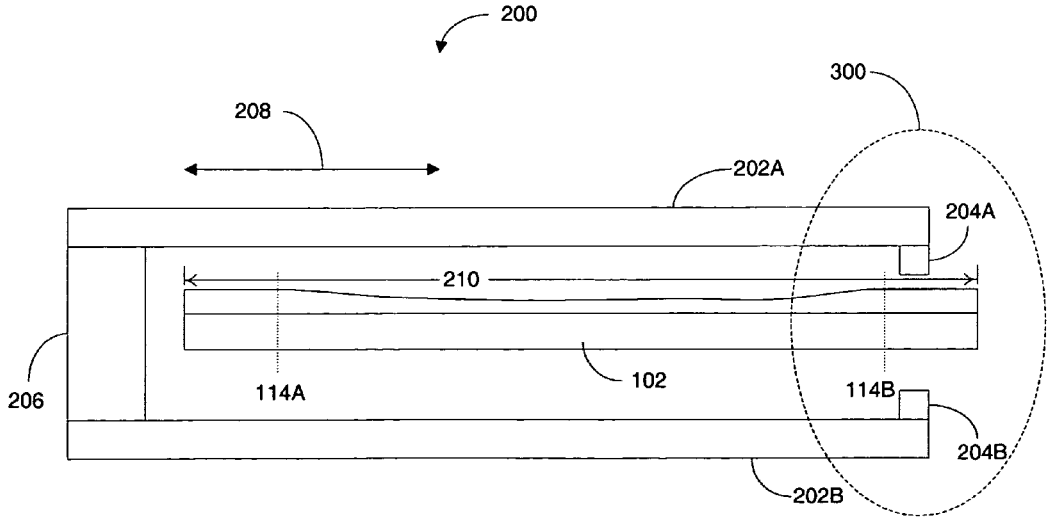
FIGS. 2A–2C are simplified diagrams of a system for measuring polishing pad thickness, in accordance with one embodiment of the present invention.
Figure 2B:
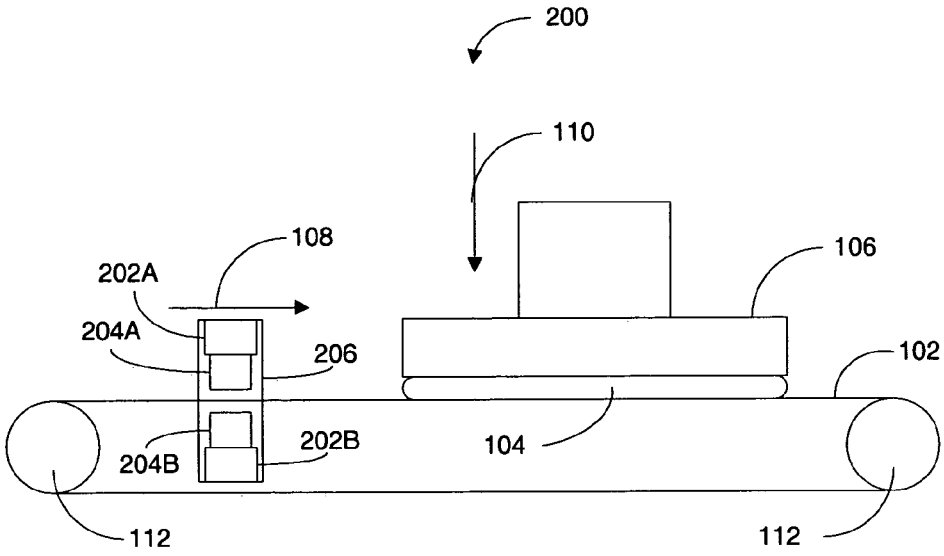
Figure 2C:
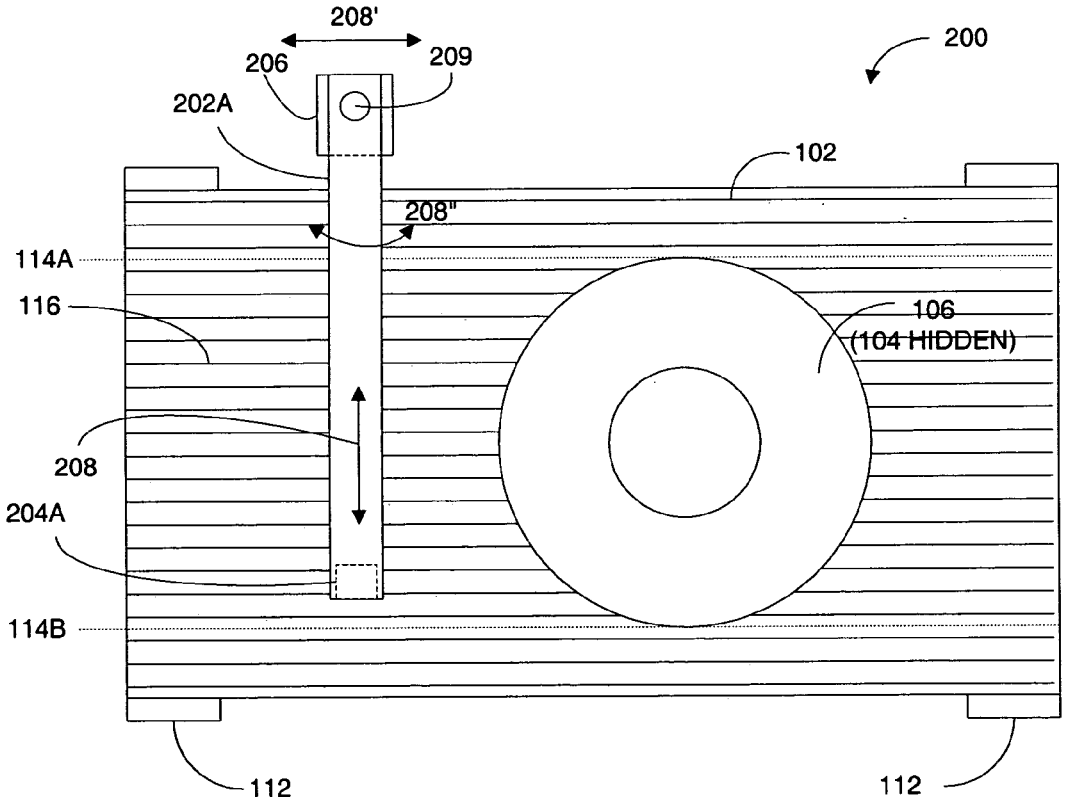

FIGS. 2A–2C are simplified diagrams of a system 200 for measuring polishing pad thickness, in accordance with one embodiment of the present invention. The system 200 includes a first sensor support 202A that supports a first sensor 204A. The system 200 also includes a second sensor support 204B that supports a second sensor 204B. The first sensor support 202A and the second sensor support 204B are connected to an actuator 206.

The actuator can move the first sensor support 202A and the second sensor support 204B in directions 208 so as to move the first sensor 204A and the second sensor 204B substantially across the width 210 of the polishing pad 102. In at least one embodiment, the actuator can move the first sensor support 202A and the second sensor support 204B in directions 208' so as to move the first sensor 204A and the second sensor 204B substantially linearly along the at least a portion of the length of the polishing pad 102. In at least one embodiment, the actuator can move the first sensor support 202A and the second sensor support 204B in an arc 208" about pivot 209. The actuator can move the first sensor support 202A and the second sensor support 204B so that, in combination with the movement of the polishing pad 102 around the rollers 112, the first sensor 204A and the second sensor 204B can substantially scan the entire area of the polishing pad. In this manner, the thickness of substantially every location on the polishing pad 102 can be determined.

In at least one embodiment, the first sensor 204A and the second sensor 204B are maintained substantially aligned, on opposing sides of the polishing pad 102. Absolute readings of each one of the proximity sensors 204A and 204B may be too sensitive to provide an accurate measurement of the wear on the polishing pad 102. A difference measurement between the two proximity sensors 204A and 204B can accurately determine the thickness of the polishing pad. The proximity sensors 204A and 204B can also be calibrated automatically or manually by means of a known thickness reference pad. The measured profile of the polishing pad 102 can be monitored automatically and can be output to a CMP process tool operator.

Figure 2D:
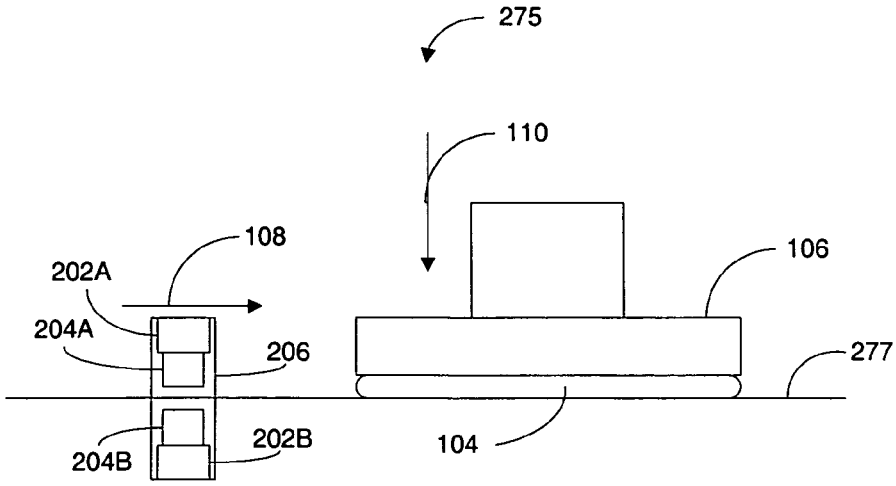
FIGS. 2D and 2E are a simplified diagrams of a system for measuring polishing pad thickness, in accordance with one embodiment of the present invention.
Figure 2E:
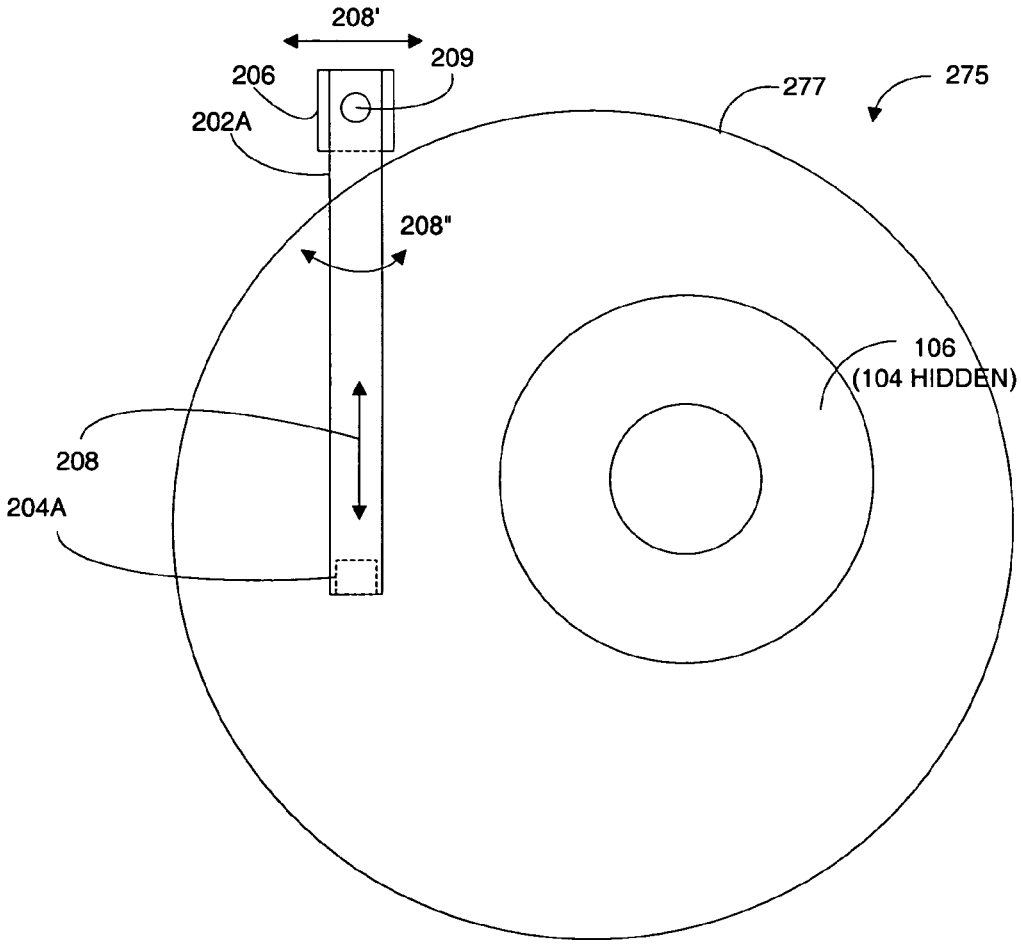

FIGS. 2D and 2E are a simplified diagrams of a system 275 for measuring polishing pad thickness, in accordance with one embodiment of the present invention. The system 275 is substantially similar to the system described in FIGS. 2A–2C above except that the system 275 is shown used on a rotary or orbital type of CMP machine. The system 275 includes a first sensor support 202A that supports a first sensor 204A and a second sensor support 202B that supports a second sensor 204B on opposing sides of the substantially round orbital or rotary polishing pad 277. The rotary/orbital polishing pad 277 is supported by a platen. The platen is not shown as the platen and polishing pad 277 combination can be considered as a single thickness to be measured.

Figure 3C:
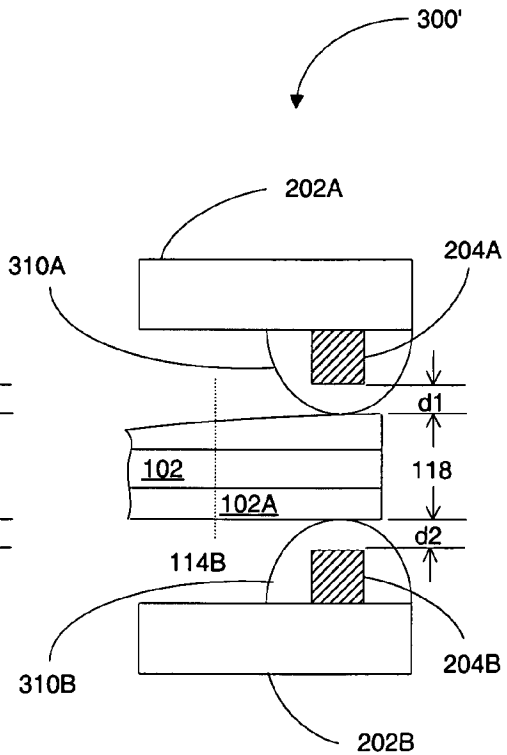
FIG. 3C is a detailed view of the sensors, in accordance with one embodiment of the present invention.
Figure 3B:
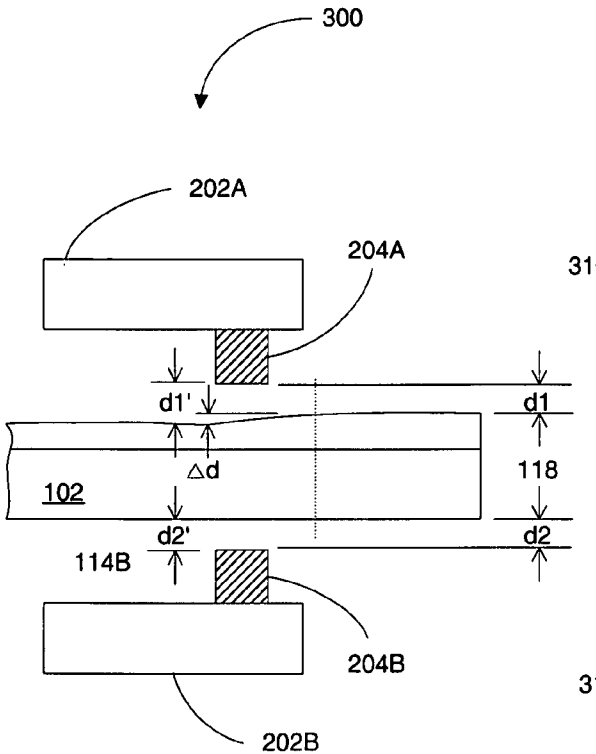
FIG. 3B shows the system measuring a thickness of the polishing pad and a second location, in accordance with one embodiment of the present invention.
Figure 3A:
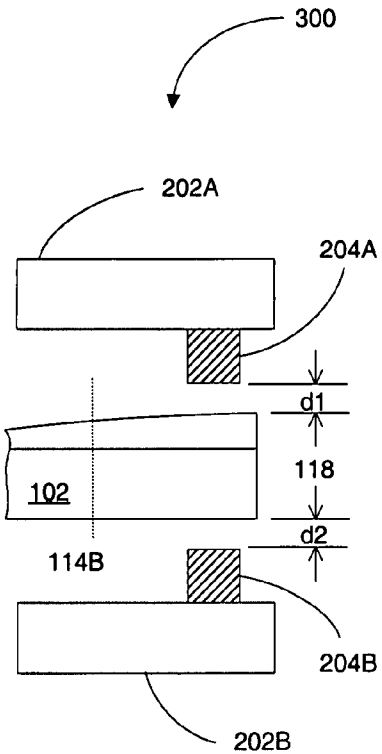
FIG. 3A is a detailed view of the sensors, measuring the polishing pad at a first location, in accordance with one embodiment of the present invention.

FIG. 3A is a detailed view 300 of the sensors 204A and 204B, measuring the polishing pad 102 at a first location, in accordance with one embodiment of the present invention. The first sensor 204A is maintained a known first distance d1 from a first surface of the polishing pad 102. The second sensor 204B is maintained a known second distance d2 from a second surface of the polishing pad 102. A fixture or a test sample or other apparatus can determine the first distance d1 and the second distance d2. The first distance d1 and the second distance d2 are maintained by the corresponding supports 202A and 202B.

As distances d1 and d2 are known, then the distance measured by the sensors 204A and 204B can be calibrated. Therefore, as the sensors 204A and 204B scan across the polishing pad 102, then differences in distances d1 and d2 can be the result of either a change in relative location of the polishing pad 102 to the sensors 204A and 204B or a change in thickness of the polishing pad 102.

As the sensors 204A and 204B scan across the polishing pad 102, the first distance d1 and the second distance d2 can vary as a result of the relative location of the polishing pad 102 between the sensors. Further, the polishing pad 102 may not always be perfectly flat and therefore may be slightly closer than distance d1 to the first sensor 204A, at a first location (i.e., distance d1'<d1), and at the first location the polishing pad 102 may be slightly farther away than distance d2 from to the second sensor 204B (i.e., distance d2'>d2). Similarly at a second location, the polishing pad 102 may be slightly closer than distance d1 to the first sensor 204A (i.e., distance d1'>d1), and at the second location the polishing pad 102 may be slightly closer than distance d2 from to the second sensor 204B (i.e., distance d2'<d2).

FIG. 3B shows the system 300 measuring a thickness of the polishing pad and a second location, in accordance with one embodiment of the present invention. Because the relative location of the polishing pad 102 between the sensors 204A and 204B can vary independent of a variation in polishing pad thickness 118, then a difference distance Δd can quantify a variation in thickness 118. Δd is calculated as follows:

$$(d1-d1')+(d2-d2')=\Delta d$$

where:

d1 is the calibrated distance between the first sensor 204A and the polishing pad 102;

d1' is the distance between the first sensor 204A and the polishing pad 102 at the location being measured;

d2 is the calibrated distance between the second sensor 204B and the polishing pad 102; and d2' is the distance between the second sensor 204B and the polishing pad 102 at the location being measured.

FIG. 3C is a detailed view 300' of the sensors 204A and 204B, in accordance with one embodiment of the present invention. The sensors 204A and 204B are covered with respective pad contacting knobs 310A and 310B. The pad contacting knobs 310A and 310B are manufactured from a material that will not interfere with the operation of the sensors 204A and 204B. By way of example, the pad contacting knobs 310A and 310B can be manufactured from plastic, ceramic, glass, etc. The pad contacting knobs 310A and 310B maintain the sensors 204A and 204B a precise distance d1 and d2 from the respective surfaces of the polishing pad 102 even as the sensors are moved across the polishing pad.

In one embodiment, the sensors 204A and 204B are eddy current sensors (ECS). Alternatively, the sensor 204A can be an ECS and the opposing sensor 204B can be a target (e.g., a conductive material) that will cause a known interference with the eddy current field flux that is emitted from the ECS 204A. The target 204B can have a thickness of at least about five skin depths. The target 204B can be a support (e.g., a platen) that has a constant thickness. Alternatively, the target 204B may not be necessary and a portion 102A of the polishing surface architecture can be a conductive material. The polishing surface architecture includes the polishing pad 102 and any underlying support structures 102A such as a metallic belt or a platen or other type of support structure. The support structures 102A can cause a known interference with the eddy current field flux that is emitted from the ECS 204A.

Figure 4:
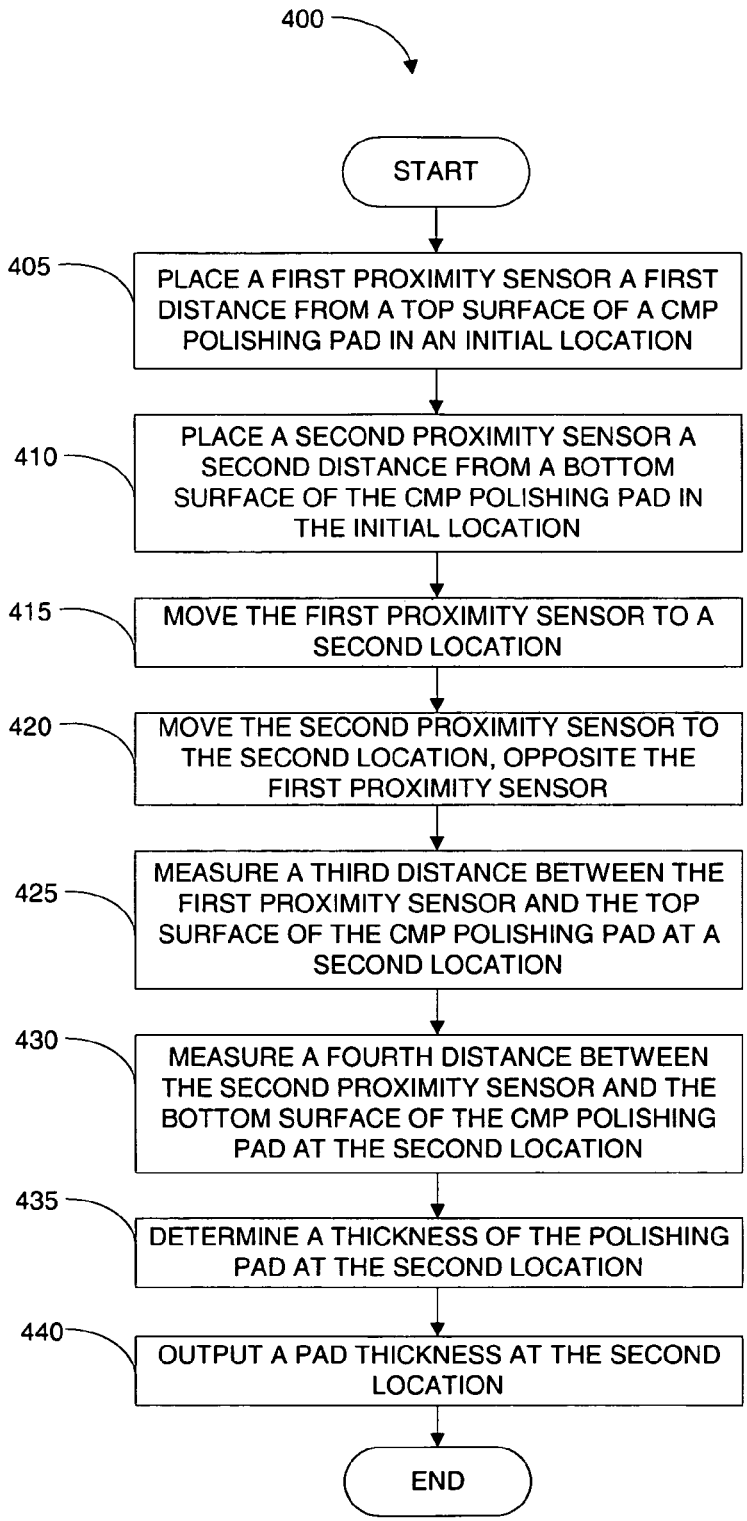
FIG. 4 is a flowchart diagram that illustrates the method operations performed in measuring a thickness of the polishing pad, in accordance with one embodiment of the present invention.

FIG. 4 is a flowchart diagram that illustrates the method operations 400 performed in measuring a thickness of the polishing pad, in accordance with one embodiment of the present invention. In an operation 405, a first proximity sensor is placed a first distance from a top surface of the CMP polishing pad in an initial location. The initial location can also be a calibration location or a calibration thickness.

In an operation 410, a second proximity sensor can be placed a second distance from a bottom surface of the CMP polishing pad in the initial location. The first and second proximity sensors are substantially aligned.

In an operation 415, the first proximity sensor is moved to a second location on the top surface of the CMP polishing pad. In an operation 420, the second proximity sensor is moved to a corresponding second location on the bottom surface of the CMP polishing pad. The first and second proximity sensors are substantially aligned.

In an operation 425, a third distance between the first proximity sensor and the top surface of the CMP polishing pad is measured at a corresponding second location. In an operation 430, a fourth distance between the second proximity sensor and the bottom surface of the CMP polishing pad is measured at the corresponding second location.

In an operation 435, a polishing pad thickness at the corresponding second location is determined. As described above, the polishing pad thickness can be determined by determining a $\Delta d$. In an operation 440, the thickness polishing pad thickness at the corresponding second location can be output.

With the above embodiments in mind, it should be understood that the invention may employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations described herein that form part of the invention are useful machine operations. The invention also relates to a device or an apparatus for performing these operations. The apparatus may be specially constructed for the required purposes, or it may be a general-purpose computer selectively activated or configured by a computer program stored in the computer. In particular, various general-purpose machines may be used with computer programs written in accordance with the teachings herein, or it may be more convenient to construct a more specialized apparatus to perform the required operations.

The invention can also be embodied as computer readable code on a computer readable medium. The computer readable medium is any data storage device that can store data that can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

It will be further appreciated that the instructions represented by the operations in the above figures are not required to be performed in the order illustrated, and that all the processing represented by the operations may not be necessary to practice the invention. Further, the processes described in any of the above figures can also be implemented in software stored in any one of or combinations of the RAM, the ROM, or the hard disk drive.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A system of measuring and scanning a CMP polishing pad thickness comprising:

a first sensor arm capable of being moved in a direction substantially parallel with and at a substantially constant top distance from a top surface of the CMP polishing pad;

a first proximity sensor mounted on the first sensor arm, the first proximity sensor being oriented toward the top surface of the CMP polishing pad, the first proximity sensor being capable of measuring a first distance between the first proximity sensor and the top surface of the CMP polishing pad;

a second sensor arm capable of being moved in a direction substantially parallel with and at a substantially constant bottom distance from a bottom surface of the CMP polishing pad; and a second proximity sensor mounted on the second sensor arm, the second proximity sensor being oriented toward the bottom surface of the CMP polishing pad, the second proximity sensor being capable of measuring a second distance between the second proximity sensor and the bottom surface of the CMP polishing pad, wherein the CMP polishing pad thickness is equal to a sum of a first difference and a second difference, the first difference equal to a difference between the top distance and the first distance, the second difference is equal to a difference between the bottom distance and the second distance.

2. The system of claim 1, wherein the first proximity sensor is an eddy current sensor.

3. The system of claim 2, wherein the CMP polishing pad is mounted on a platen.

4. The system of claim 3, wherein the platen has a thickness greater than at least about five skin depths.

5. The system of claim 2, wherein the first proximity sensor includes a cover, wherein the cover has a thickness equal to the first distance.

6. The system of claim 5, wherein the cover has a low co-efficient of friction with the top surface of the polishing pad.

7. The system of claim 6, wherein the first sensor arm holds the cover of the first proximity sensor against the top surface of the polishing pad.

8. The system of claim 1, wherein the polishing pad includes a conductive portion.

9. The system of claim 1, wherein the first proximity sensor and the second proximity sensor are substantially aligned along in an axis that is substantially perpendicular to the top surface and the bottom surface of the CMP polishing pad.

10. The system of claim 1, wherein the CMP polishing pad is mounted on a continuous belt and wherein the continuous belt is mounted on a pair of rollers.

11. The system of claim 1, wherein the first proximity sensor is at least one of a group consisting of a laser proximity sensor and a capacitive proximity sensor.

12. The system of claim 1, wherein the first proximity sensor is an eddy current sensor (ECS) and the second proximity sensor is a target.

13. The system of claim 12, wherein the target is a conductive portion of the polishing surface architecture.

14. The system of claim 13, wherein the polishing surface architecture includes at least one of a platen or a metallic part of the polishing belt.

15. The system of claim 1, wherein the CMP polishing pad is mounted within a CMP process tool.

16. A method of measuring a thickness of a CMP polishing pad comprising:

placing a first proximity sensor a first distance from a top surface of the CMP polishing pad in an initial location;

moving the first proximity sensor to a second location;

measuring a second distance between the first proximity sensor and the top surface of the CMP polishing pad at the second location;

placing a second proximity sensor a third distance from a bottom surface of the CMP polishing pad in the initial location;

moving the second proximity sensor to the second location on the bottom surface of the CMP polishing pad; and measuring a fourth distance between the second proximity sensor and the bottom surface of the CMP polishing pad at the second location;

determining a thickness of the CMP polishing pad at the second location, wherein the CMP polishing pad thickness is equal to a sum of a first difference and a second difference, the first difference equal to a difference between the first distance and the second distance, the second difference equal to a difference between the third distance and the fourth distance; and outputting the thickness of the CMP polishing pad at the second location.

17. The method of claim 16, wherein the first proximity sensor is an eddy current sensor and a target is located below the CMP polishing pad at the second location.

18. The method of claim 17, wherein the target is a platen.

19. The method of claim 16, determining the thickness of the CMP polishing pad at the second location includes determining the thickness of the CMP polishing pad at the second location in-situ.

* * * * *